US009673538B2

(12) United States Patent
Pan et al.

(10) Patent No.: US 9,673,538 B2
(45) Date of Patent: Jun. 6, 2017

(54) CONNECTOR

(71) Applicant: Tyco Electronics (Shanghai) Co. Ltd., Shanghai (CN)

(72) Inventors: Lei Pan, Shanghai (CN); Biao Pan, Shanghai (CN); Yuhong Mao, Shanghai (CN); Tongbao Ding, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 14/697,762

(22) Filed: Apr. 28, 2015

(65) Prior Publication Data

US 2015/0311607 A1 Oct. 29, 2015

(30) Foreign Application Priority Data

Apr. 28, 2014 (CN) ..... 2014 2 0225632 U

(51) Int. Cl.
*H01R 4/24* (2006.01)
*H01R 4/22* (2006.01)

(52) U.S. Cl.
CPC ..... *H01R 4/2433* (2013.01); *H01R 4/22* (2013.01); *H01R 4/2416* (2013.01)

(58) Field of Classification Search
CPC ..... H01R 4/2433
See application file for complete search history.

(56) References Cited

U.S. PATENT DOCUMENTS 3,899,236 A * 8/1975 Santos ..... H01R 4/2433 439/402
5,415,562 A * 5/1995 Matsumoto ..... H01R 4/2433 439/397
5,820,404 A * 10/1998 Chishima ..... H01R 4/2454 439/404
5,954,541 A * 9/1999 Ozai ..... H01R 13/65807 439/404
6,361,353 B1 * 3/2002 Saka ..... H01R 4/2433 439/405
6,544,070 B1 * 4/2003 Radliff ..... H01R 4/2433 439/467
7,267,571 B1 * 9/2007 Twigg ..... H01R 4/2433 439/402
2002/0055295 A1 * 5/2002 Itai ..... H01R 31/085 439/402
2003/0153207 A1 * 8/2003 Lin ..... H01R 4/2454 439/402

(Continued)

*Primary Examiner* — James Harvey
(74) *Attorney, Agent, or Firm* — Barley Snyder

(57) ABSTRACT

An electrical connector has a connector housing, a conductive contact, and a housing cover. The connector housing has a plurality of wire receiving passageways, and a plurality of elastic wire holders. The conductive contact has a plurality of wire insulation cutting blades electrically connected together, each cutting blade having a tapered tip. The housing cover is connected to the conductive contact, and together with the conductive contact, is positioned on the connector housing such that when a plurality of conductive wires are positioned in the plurality of wire receiving passageways, after the housing cover has been positioned on the connector housing, the conductive contact has pierced through an outer insulation sheath of the conductive wires and is in contact with a conductive core thereof.

23 Claims, 6 Drawing Sheets

(56) References Cited

U.S. PATENT DOCUMENTS

| | | | | |
|---|---|---|---|---|
| 2004/0097125 | A1* | 5/2004 | Freakes | H01R 4/2425<br>439/402 |
| 2005/0070147 | A1* | 3/2005 | Hung | H01R 43/015<br>439/352 |
| 2011/0059632 | A1* | 3/2011 | Bishop | H01R 4/2433<br>439/78 |
| 2015/0311607 | A1* | 10/2015 | Ding | H01R 4/22<br>439/402 |

* cited by examiner

CONNECTOR

CROSS-REFERENCE TO RELATED APPLICATION

This application claims the benefit of the filing date under 35 U.S.C. §119(a)-(d) or (f) of Chinese Patent Application No. 201420225632.3 filed on Apr. 28, 2014.

FIELD OF THE INVENTION

The invention is generally related to an electrical connector, and, more specifically, to a piercing electrical connector.

BACKGROUND

A piercing connector is an electrical connector for electrically connecting a plurality of insulated conductive wires. In the piercing connector, the plurality of insulated conductive wires are pierced through outer insulating sheathes and thus are connected with each other. The piercing connector, as a connector for quickly and easily connecting various kinds of insulated conductive wires such as telephone lines, network cables, power wires, or the like, has been widely used in a variety of applications for connecting insulated conductive wires.

However, one problem existing in conventional piercing connectors is that during use, the conductive wires are not reliably fixed and easily shift to slip and become disengaged. Thus the inserted conductive wires cannot be held in place well. Another problem is that only one type of piercing connector can only be used for wires of same diameters, and is unable to be used in application requiring the use of various wires of different diameters.

SUMMARY

An electrical connector has a connector housing, a conductive contact, and a housing cover. The connector housing has a plurality of wire receiving passageways, and a plurality of elastic wire holders. The conductive contact has a plurality of wire insulation cutting blades electrically connected together, each cutting blade having a tapered tip. The housing cover is connected to the conductive contact, and together with the conductive contact, is positioned on the connector housing such that when a plurality of conductive wires are positioned in the plurality of wire receiving passageways, after the housing cover has been positioned on the connector housing, the conductive contact has pierced through an outer insulation sheath of the conductive wires and is in contact with a conductive core thereof.

BRIEF DESCRIPTION OF THE DRAWINGS

The invention will now be described by way of example, with reference to the accompanying Figures, of which.

DETAILED DESCRIPTION OF THE EMBODIMENT(S)

Figure 1:
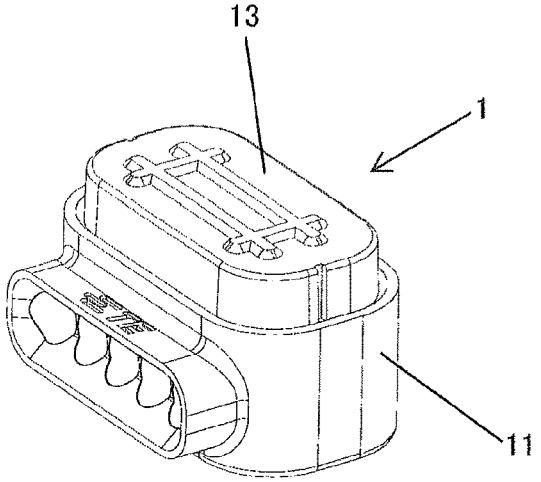
FIG. 1 is a perspective view of a piercing connector.
Figure 2:
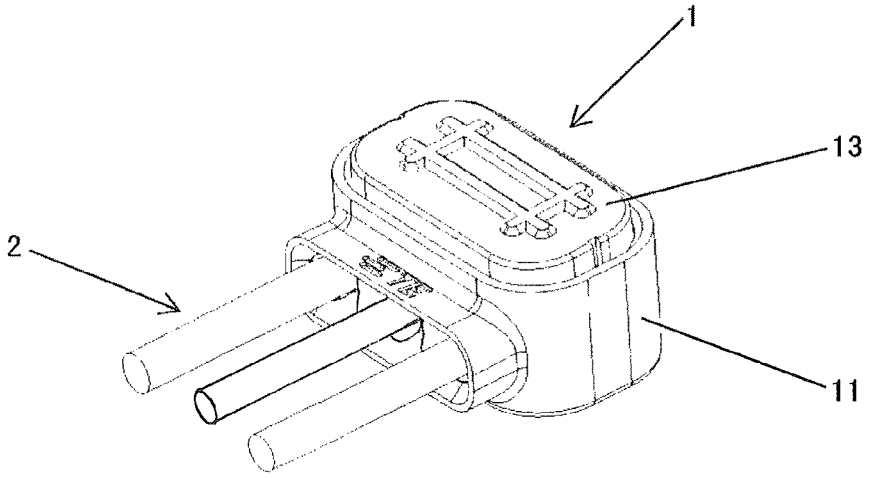
FIG. 2 is a perspective view of the piercing connector having inserted conductive wires.
Figure 3:
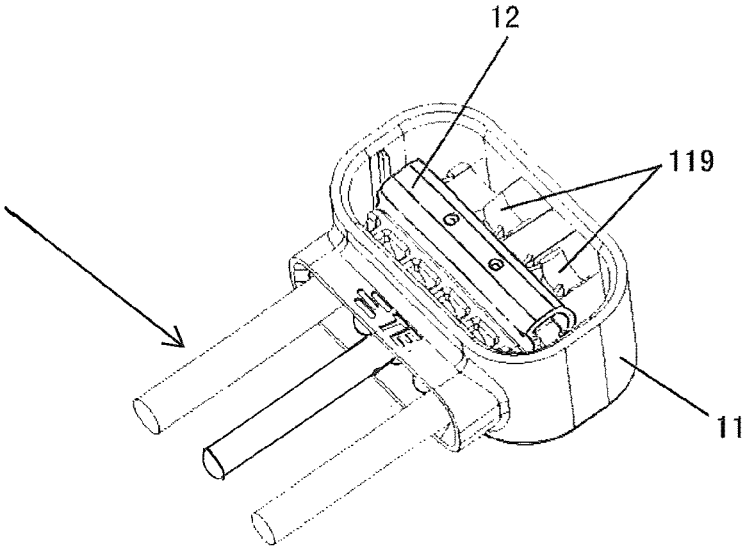
FIG. 3 is a perspective view of the piercing connector with a housing cover removed.
Figure 4:
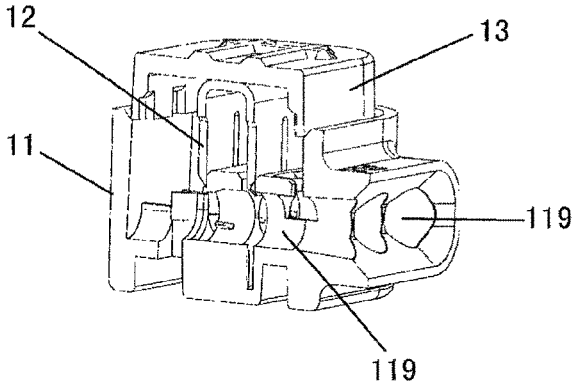
FIG. 4 is a sectional view of the piercing connector.

Embodiments of a piercing connector 1 will be described hereinafter with reference to FIGS. 1-10.

In the description, the same reference number indicates the same part. The described embodiments are merely intended to exemplify a general concept of the invention and are not intended to limit the scope of the invention.

In the embodiments shown in FIGS. 1-6, the piercing connector 1 is used to electrically connect a plurality of insulated conductive wires 2. Generally, the piercing connector 1 comprises an insulating connector housing 11, an insulating housing cover 13 and a conductive contact 12. The connector housing 11 and housing cover 13 may be molded from plastic materials or other suitable dielectric materials. The conductive contact 12 may be made of a metal material such as copper. The insulated conductive wire 2 comprises an insulating outer sheath and a conductive core portion.

The connector housing 11 has wire receiving passageways 119 for inserting the insulated conductive wires 2 therein. The conductive contact 12 has a substantially U-shaped groove with a bottom plate and two side plates extending from the bottom plate. (See FIGS. 6*a* and 6*b*) The conductive contact 12 is positioned on the connector housing 11 to extend in a direction traversing a direction in which the conductive wires 2 extend. Each side plate of the conductive contact 12 has a plurality of cutting blades 120 separated by insulating cutting grooves, with each cutting blade 120 having a tapered tip. When the conductive wires 2 are inserted into the wire receiving passageways 119 of the connector housing 11, the conductive wires 2 are respectively located within the respective insulation cutting grooves between cutting blades 120. The housing cover 13 is mounted on the connector housing 11 to push the conductive contact 12, so that the conductive contact 12 pierces and cuts the outer insulating sheathes of the conductive wires 2 within the wire receiving passageways 119 of the connector housing 11.

Figure 7A:
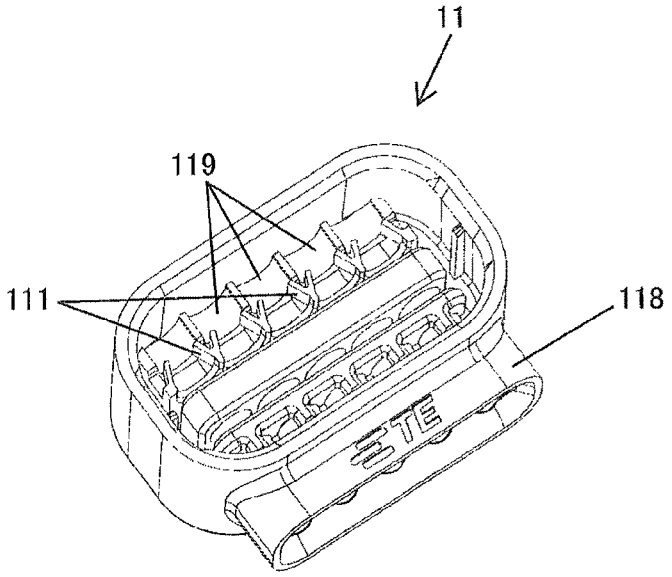
FIG. 7*a* is a perspective view of a connector housing.
Figure 7B:
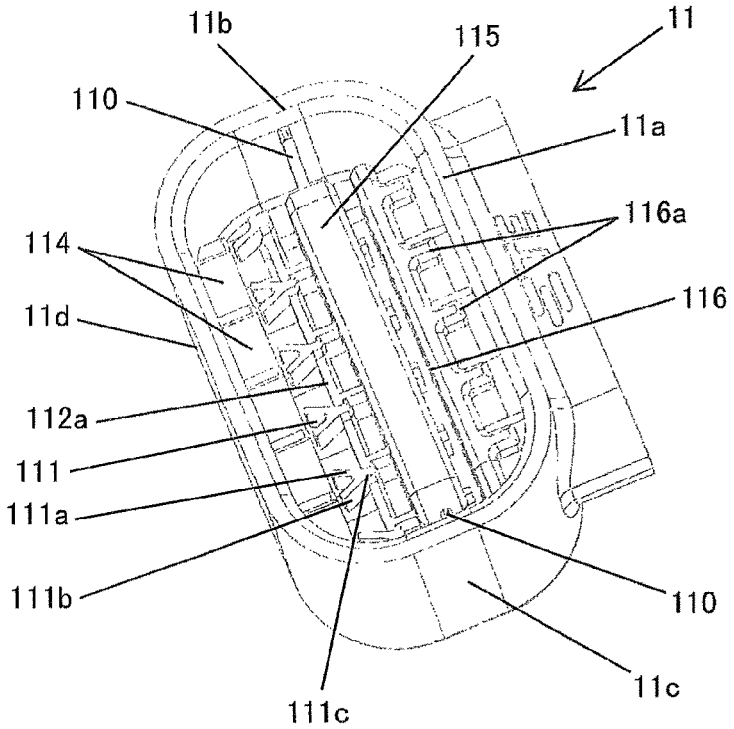
FIG. 7*b* is an enlarged perspective view of the connector housing in FIG. 7*a;*
Figure 8:
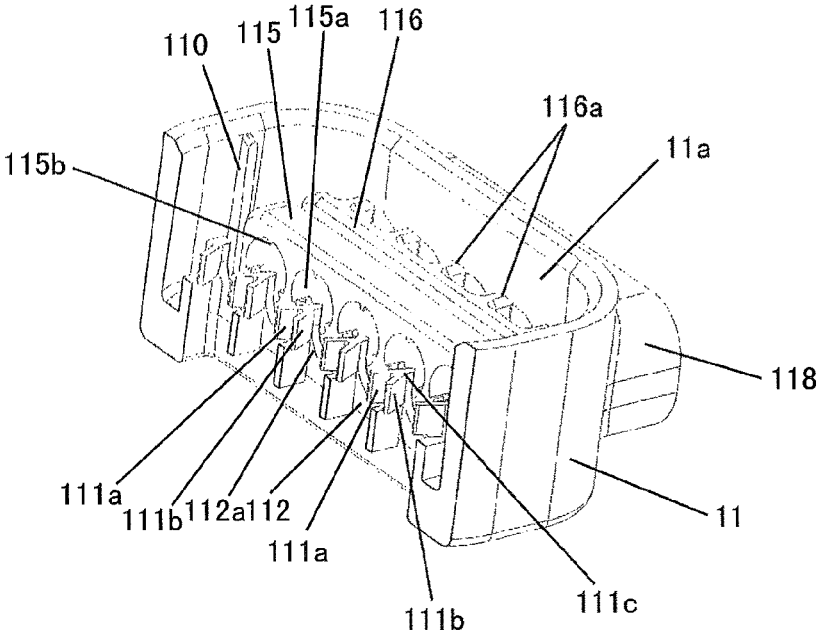
FIG. 8 is a partial cross-sectional view of the connector housing.

In the embodiments shown in FIGS. 7 and 8, the connector housing 11 further comprises a plurality of elastic wire holders 111 that hold the plurality of conductive wires 2 positioned in the wire receiving passageways 119 of the connector housing 11. The plurality of elastic wire holders 111 are positioned adjacent to each other. Each elastic wire holder 111 has an approximately Y-shaped structure integrally formed on the connector housing 11, having a base portion 111*c* and two elastic biased leg portions 111*a* and 111*b*. During insertion of the conductive wires 2 into the wire receiving passageways 119, the two leg portions 111*a* and 111*b* belonging to two adjacent Y-shaped structures, respectively, and facing each other, elastically contract so as to smoothly guide the insertion of the conductive wires 2. The two leg portions 111*a* and 111*b* are biased toward each inserted conductive wire 2. When the conductive wires 2 in the wire receiving passageways 119 start to displace and shift positions, the leg portions 111*a* and 111*b* of the Y-shaped structures elastically expand outward to tightly clamp the conductive wires, thus preventing the conductive wires 2 from shifting and disengaging. Thereby the Y-shaped structures of the elastic wire holders 111 securely hold the conductive wires 2 after the conductive wires 2 have been positioned in the wire receiving passageways 110 of the connector housing 11.

When the conductive contact 12 is pushed by the housing cover 13, the cutting blades 120 of the conductive contact 12 respectively cut and pierce the outer insulating sheathes of the conductive wires 2, and the conductive contact 12 contacts the conductive core portions of the conductive wires 2. Thus, the insulated conductive wires 2 become electrically connected to one another through the conductive contact 2. Further, since the elastic wire holders 111 have elasticity freedom within a range, conductive wires 2 having different wire diameters can be held and secured by the elastic wire holders 111, so that the piercing connector 1 can be used to connect conductive wires of various diameters.

The detailed structure of the connector housing will be described with reference to FIGS. 7-9. In the embodiments shown in FIGS. 7-9, the connector housing 11 is a substantially rectangular box having an opening on a top end, a bottom wall 11*e* and peripheral first sidewall 11*a*, second sidewall 11*b*, third sidewall 11*c*, and fourth sidewall 11*d*. The interior of the connector housing 11 has a receiving space (not labeled). The bottom wall 11*e* has a first plate 112 extending upward into the receiving space from an inner facing surface of the bottom wall 11*e*, toward the opening on the top end. A top surface of the first plate 112 has a plurality of semicircular grooves 112*a* that are elements of the wire receiving passageways 119 for guiding the conductive wires 2. The base portion 111*c* of the Y-shaped structure of the elastic wire holder 111 is connected to the first plate 112 at a position between the semicircular grooves 112*a*, so that the elastic wire holder 111 of the Y-shaped structure integrally protrudes from the first plate 112.

The first sidewall 11*a* of the connector housing 11 has a plurality of first wire receiving through holes (not shown), as parts of the wire receiving passageways 119 for guiding the conductive wires 2, through which the insulated conductive wires 2 extend there through.

In the embodiments shown in FIGS. 7 and 8, the connector housing 11 further comprises a second plate 115 extending upward into the receiving space from the inner facing surface from the bottom wall 11*e*, toward the opening on the top end. The second plate 115 has a plurality of second wire receiving through holes 115*a* (FIG. 8), as parts of the wire receiving passageways 119 for guiding the conductive wires 2, through which the insulated conductive wires 2 extend there through. Further, the second plate 115 is positioned proximate to the first sidewall 11*a* of the connector housing 11, between the first sidewall 11*a* and the first plate 112.

In the embodiment shown in FIG. 8, a plurality of raised ribs 115*b* are disposed on an inner surface of each second wire receiving through hole 115*a* in the second plate 115. Each raised rib 115*b* extending longitudinally through the second wire receiving through hole 115*a*, and serves to fix the positions of the conductive wires 2 therein, enhancing connection reliability. In an embodiment, three raised ribs 115*b* are position in each wire receiving through hole 115*a*, being spaced apart by approximately 120 degrees.

In the embodiments shown in FIGS. 7 and 8, the connector housing 11 further comprises a third plate 116 extending upward into the receiving space from the inner facing surface from the bottom wall 11*e*, toward the opening on the top end. The third plate 116 has a plurality of third wire receiving through holes (not shown), as parts of the wire receiving passageways 119 for guiding the conductive wires 2, through which the insulated conductive wires 2 extend there through. Further, the third plate 116 is positioned proximate the first sidewall 11*a* of the connector housing 11, between the first sidewall 11*a* and the second plate 115.

A plurality of projections 116*a* are disposed on the third plate 116 at positions between each of the third wire receiving through holes, each extending from a top surface of the third plate 116 toward the first sidewall 11*a* of the connector housing 11, thereby preventing deflection of the conductive wires.

Figure 9:
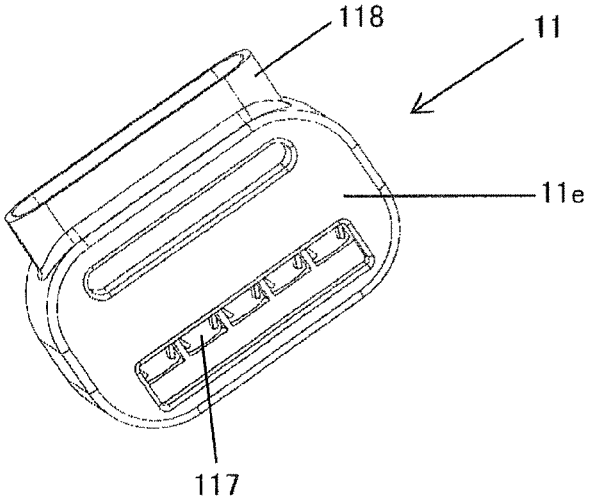
FIG. 9 is a bottom perspective view of the connector housing.

In an embodiment shown in FIG. 9, a wire observation opening 117 is disposed in the bottom wall 11*e* of the connector housing 11 at a position corresponding to the elastic wire holders 111, so as to expose the elastic wire holders 11. The wire observation opening 117 enables a user to observe the conductive wires 2 from a position outside the connector housing 11 during inserting the conductive wires 2.

In an embodiment shown in FIG. 7, the fourth sidewall 11*d* of the connector housing 11, facing the first sidewall 11*a*, has integrated semicircular wire guiding grooves 114 extending outwards toward the first sidewall 11*a*. The wire guiding grooves 114 are additional components of the wire receiving passageways 119 of the connector housing 11, and act as guides for the inserted conductive wires 2.

In the embodiments shown in FIGS. 7-8, cylindrically shaped wire receiving projections 118 are integrally formed on an outer surface of the first sidewall 11*a*. Each wire receiving projection 118 surrounds each of the first wire receiving through holes (not shown) for passing the conductive wires 2 there through so as to protect the conductive wires 2.

Cover guiding ribs 110 are respectively positioned on inner surfaces of the opposing second and third sidewalls 11*b*, 11*c* of the connector housing 11 connected with the first sidewall 11*a*. Correspondingly, as shown in FIG. 10, complimentary guide grooves 130 are positioned on corresponding outer surfaces of the sidewalls of the housing cover 13. The guide grooves 130 slidably engage the cover guiding ribs 110 so as to guide the insertion of the housing cover 13 into the connector housing 11. Further, stop protrusions 130*a* are formed in the guide grooves 130 for defining a preassembling position for the housing cover 13.

Figure 5A:
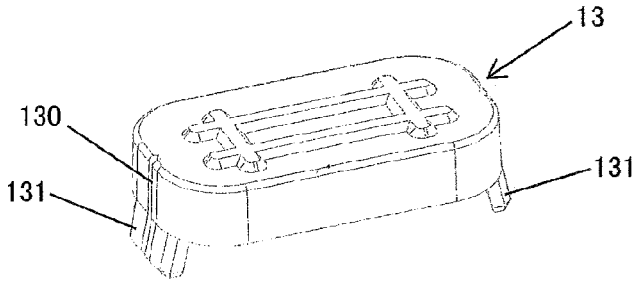
FIG. 5*a* is a perspective view of an outer surface the housing cover.
Figure 5B:
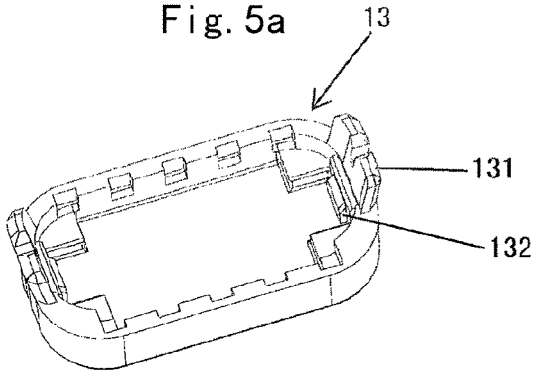
FIG. 5*b* is a perspective view of an inner surface of the housing cover.
Figure 6A:
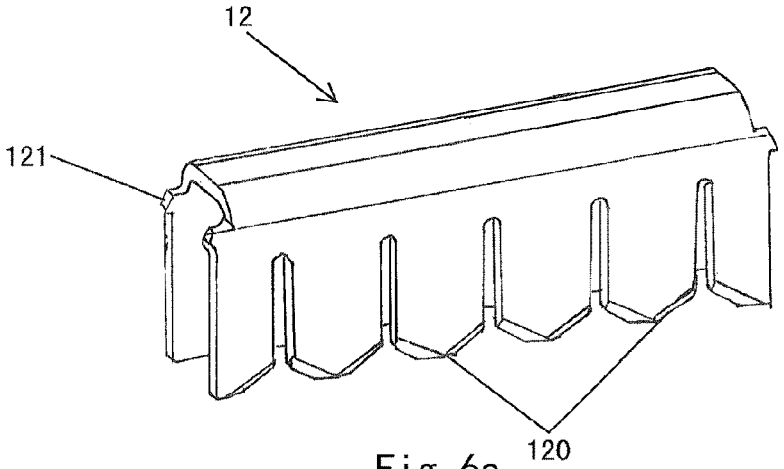
FIG. 6*a* is a perspective view of a conductive contact.
Figure 6B:
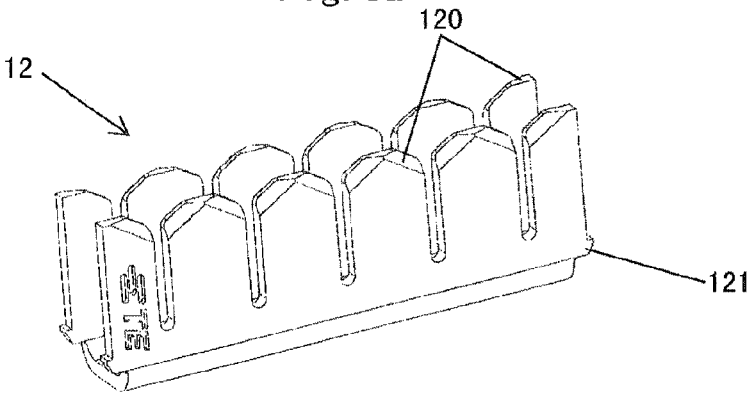
FIG. 6*b* is another perspective view of the conductive contact.
Figure 10A:
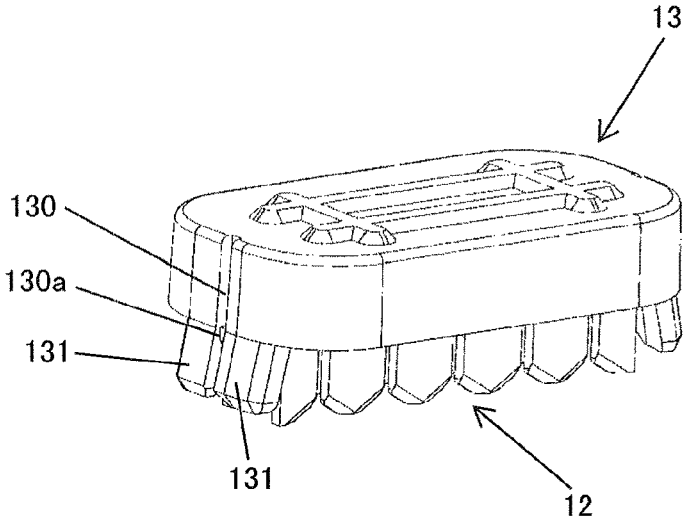
FIG. 10*a* is a perspective view of a top of the housing cover and the conductive contact assembled together.

In the embodiments shown in FIGS. 5 and 10*a*/10*b*, the housing cover 13 further comprises inclined locking tabs 131 extending from two sides of each guide groove 130, the inclined locking tabs 131 have certain elasticity so that they can elastically abut against the inner wall of the connector housing 11 after the housing cover 13 is inserted into the connector housing 11, thereby stably connecting the housing cover 13 and the connector housing 11.

Figure 10B:
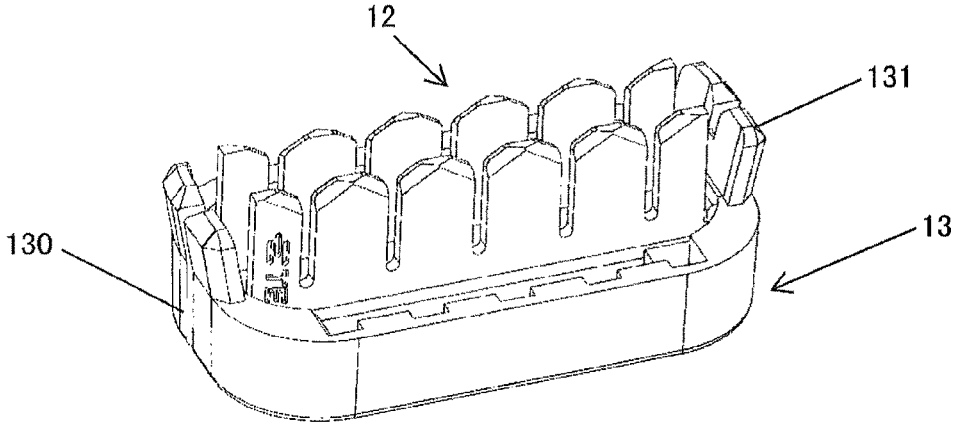
FIG. 10*b* is a perspective view of a bottom of the housing cover and the conductive contact assembled together.

The embodiments of FIGS. 10*a* and 10*b* show assembled views of the housing cover 13 and the conductive contact 12. The housing cover 11 and the conductive contact 12 may be fixedly assembled together through a snap-in mechanism. For example, the housing cover 11 comprises a boss 132 (See FIG. 5*b*), below which a recess is formed, and the conductive contact 12 comprises a complimentary boss engaging protrusion 121 (See FIG. 6*a*), which is engaged into the recess below the boss 132 through a snap-in connection.

Of course, those of ordinary skill in the art would appreciate that in other embodiments, other engagement mechanisms for fixedly connecting the housing cover 11 and the conductive contact 12 can be used. For example, the housing cover 13 comprises a first engagement mechanism, the conductive contact 12 comprises a second engagement mechanism 121 that fixedly engages with the first engagement mechanism.

The assembled housing cover 13 and conductive contact 12 are assembled with the connector housing 11 as follows: first, the housing cover 13 is inserted in the connector housing 11 by aligning the guide grooves 130 of the housing cover 13 with the cover guiding ribs 110 of the connector housing 11. Next, the housing cover 13 is pressed down manually or by a machine so that the guide grooves 130 of the housing cover 13 slide along the cover guiding ribs 110 of the connector housing 11. When the guide grooves 130 slide to a position where the stop protrusions 130*a* of the guide groves 130 contact the cover guiding ribs 110, and the housing cover 13 movement is stopped, thereby finishing a preassembly. Next, when the conductive wires 2 need to be pieced, the housing cover 13 is further pressed downward, so that the housing cover 13 slides over the stop protrusions 130*a* to continue to travel to a final stop position (not shown) on the connector housing 11. When pressing down the housing cover 13, the cutting blades 120 of the conductive contact 12 fixed to the housing cover 13 pierce and cut the insulating outer sheathes of the conductive wires 2 (FIG. 2), so that the conductive wires 2 are electrically connected to each other through the conductive contact 12.

As described above, since the elastic wire holders are provided for holding the conductive wires, the conductive wires can be stably held and prevented from being displaced and subsequently disengaging, thereby ensuring good effects of piercing and connecting the conductive wires. Further, since the elastic wire holders are elastic, the piercing connector can be suitable for connections of conductive wires of various diameters.

Although several exemplary embodiments have been shown and described, it would be appreciated by those skilled in the art that various changes or modifications may be made in these embodiments without departing from the principles and spirit of the disclosure, the scope of which is defined in the claims and their equivalents, and the present invention is not limited to the described and showed exemplary embodiments. It should be noted that the wording "comprising" or "including" does not exclude other elements or steps and the wording "a" or "an" does not exclude a plural number of elements. The reference numerals appeared in the claims would not be appreciated to limit the scope of the invention.

What is claimed is:

1. An electrical connector, comprising:

a connector housing having a plurality of wire receiving passageways, and a plurality of elastic wire holders, each elastic wire holder is a Y-shaped structure integrally formed on the connector housing;

a conductive insulation displacement contact (IDC) having a plurality of wire insulation cutting blades electrically connected together; and a housing cover connected to the IDC, and together with the IDC being positioned on the connector housing.

2. The electrical connector according to claim 1, wherein the plurality of wire insulation cutting blades extend from a bottom plate of the IDC.

3. The electrical connector according to claim 1, wherein the Y-shaped structure has a base portion; and two adjacent elastic leg portions connected to an end of the base portion and facing each other.

4. The electrical connector according to claim 3, wherein the two leg portions are elastically biased toward an inserted conductive wire in the wire receiving passageway.

5. The electrical connector according to claim 4, wherein the connector housing is substantially box-like having a receiving space positioned in an interior of the connector housing, peripheral sidewalls, an opening on a top end, and a bottom wall having a first plate extending upward into the receiving space, the first plate having a top surface with a plurality of wire guiding grooves.

6. The electrical connector according to claim 5, wherein the base portion of the Y-shaped structure is connected to the first plate at a position between adjacent wire guiding grooves so that the Y-shaped structure integrally protrudes into the receiving space from the first plate.

7. The electrical connector according to claim 6, wherein the peripheral sidewalls include a first sidewall, the plurality of wire receiving passageways extending through the first sidewall.

8. The electrical connector according to claim 7, wherein the bottom wall of the connector housing further includes a second plate extending upward into the receiving space.

9. The electrical connector according to claim 8, wherein the second plate has a plurality of second wire receiving through holes.

10. The electrical connector according to claim 9, wherein the second plate is positioned proximate to the first sidewall, between the first sidewall and the first plate.

11. The electrical connector according to claim 10, wherein the bottom wall of the connector housing further includes a third plate extending upward into the receiving space.

12. The electrical connector according to claim 11, wherein the third plate has a plurality of third wire receiving through holes.

13. The electrical connector according to claim 12, wherein the third plate is positioned proximate to the first sidewall, between the first sidewall and the second plate.

14. The electrical connector according to claim 9, wherein each second wire receiving through hole has an inner surface with a plurality of raised ribs extending longitudinally through the second wire receiving through hole.

15. The electrical connector according to claim 12, wherein a plurality of projections are disposed on the third plate at positions between two third wire receiving through holes, each extending from a top surface of the third plate toward the first sidewall of the connector housing.

16. The electrical connector according to claim 6, wherein a wire observation opening is disposed in the bottom wall of the connector housing at a position corresponding to the plurality of elastic wire holders.

17. The electrical connector according to claim 6, wherein the peripheral sidewalls include a fourth sidewall positioned opposing to the first sidewall, having a plurality of integrated wire guiding grooves.

18. The electrical connector according to claim 7, wherein a cylindrically shaped wire receiving projection is integrally formed on an outer surface the first sidewall of the connector housing to surround the plurality of first wire receiving through holes.

19. The electrical connector according to claim 6, wherein cover guiding ribs are respectively positioned on inner surfaces of two opposite sidewalls of the connector housing connected with the first sidewall, and complimentary guide grooves are positioned on corresponding sidewalls of the housing cover, such that when the housing cover is connected to the connector housing the cover guiding ribs are slidably engaged with guide grooves.

20. The electrical connector according to claim 19, wherein preassembly stop protrusions are positioned in the guide grooves.

21. The electrical connector according to claim 19, wherein the housing cover further comprises inclined locking tabs extending from two sides of each guide groove, each locking tab elastically abutting against the inner surface of one of the peripheral sidewalls of the connector housing when the housing cover positioned on the connector housing.

22. The electrical connector according to claim 1, wherein the housing cover has a first engagement mechanism, and the IDC has a complimentary second engagement mechanism engaged with the first engagement mechanism to connect the IDC to the housing cover.

23. The electrical connector according to claim 2, wherein each of the plurality of wire insulation cutting blades extends to a tapered tip at an end opposite the bottom plate.

* * * * *